US010645980B2

(12) United States Patent
Rao et al.

(10) Patent No.: US 10,645,980 B2
(45) Date of Patent: May 12, 2020

(54) VEST ASSEMBLY

(71) Applicant: CoreMechanics, LLC, Narragansett, RI (US)

(72) Inventors: Jerome A. Rao, Narragansett, RI (US); Brooke Rao, Narragansett, RI (US); John Lansing, Seekonk, MA (US); Judy Lansing, Seekonk, MA (US)

(73) Assignee: CoreMechanics, LLC, Narragansett, RI (US)

( * ) Notice: Subject to any disclaimer, the term of this patent is extended or adjusted under 35 U.S.C. 154(b) by 0 days.

(21) Appl. No.: 15/262,487

(22) Filed: Sep. 12, 2016

(65) Prior Publication Data

US 2017/0071265 A1 Mar. 16, 2017

Related U.S. Application Data

(60) Provisional application No. 62/216,690, filed on Sep. 10, 2015.

(51) Int. Cl.
*A41D 1/04* (2006.01)
*A63B 21/00* (2006.01)

(52) U.S. Cl.
CPC ..... *A41D 1/04* (2013.01); *A63B 21/00* (2013.01); *A41D 2400/38* (2013.01)

(58) Field of Classification Search
CPC ..... A41D 1/04; A41D 2400/38; A41D 15/00; A41D 27/201; A41D 31/00; A41D 2300/322; A63B 21/00; A63B 21/0004; A63B 21/00061; A63B 21/05; A63B 23/0238
USPC ..... 2/102
See application file for complete search history.

(56) References Cited

U.S. PATENT DOCUMENTS 4,336,807 A 6/1982 Benckhuijsen
4,669,127 A * 6/1987 Swanson ..... A41D 13/0012 2/102
5,144,694 A * 9/1992 Conrad Da oud ... A63B 21/065 2/102
5,206,957 A * 5/1993 Gulick ..... A41D 13/00 2/102
5,729,832 A * 3/1998 Grilliot ..... A41D 13/00 2/2.5
6,260,196 B1 * 7/2001 van der Sleesen .. A41D 13/015 2/2.5
6,485,446 B1 * 11/2002 Brother ..... A41D 13/06 2/455
6,748,601 B2 * 6/2004 LaShoto ..... A41D 13/015 2/102

(Continued)

*Primary Examiner* — Anne M Kozak
(74) *Attorney, Agent, or Firm* — Adler Pollock & Sheehan P.C.

(57) ABSTRACT

A vest assembly includes a bodice having at least one front pocket and at least one back pocket. A neck collar attaches to the bodice. Preferably, the neck collar includes compressive material to provide cushion and resistance. A collar adjustment, typically an elasticized material, providing adjustable resistance to the neck collar. A plurality of compressive inserts can be selectively inserted in the front pocket and/or the back pocket of the vest assembly. Each compressive insert is a compressive material to provide resistance to a frontal area of a chest of a user. The plurality of compressive inserts are interchangeable and come in varying weights and compressive and/or tensile strengths.

10 Claims, 4 Drawing Sheets

(56) References Cited

U.S. PATENT DOCUMENTS

| | | | | |
|---|---|---|---|---|
| 7,681,249 | B2 | 3/2010 | Oliver et al. | |
| 8,555,412 | B2 * | 10/2013 | Aquino | F41H 1/02 2/2.5 |
| 9,775,384 | B2 * | 10/2017 | Harding | A41D 1/04 |
| 2005/0075046 | A1 * | 4/2005 | Williams | A41D 13/05 450/1 |
| 2005/0229282 | A1 * | 10/2005 | Davis | A41D 13/015 2/69 |
| 2010/0186154 | A1 * | 7/2010 | Krueger | A41D 13/0151 2/459 |
| 2012/0102633 | A1 * | 5/2012 | Aulenbach | A41D 13/0155 2/455 |
| 2014/0259333 | A1 * | 9/2014 | Marquez | A63B 71/12 2/459 |
| 2014/0302970 | A1 * | 10/2014 | Sinclair | A63B 21/065 482/105 |
| 2014/0303532 | A1 | 10/2014 | Harding | |
| 2015/0196067 | A1 * | 7/2015 | Blakely | A41D 1/04 2/69 |
| 2015/0290901 | A1 * | 10/2015 | Banowit | B32B 3/20 428/188 |
| 2017/0156415 | A1 * | 6/2017 | Winner | A41D 13/0575 |
| 2017/0199011 | A1 * | 7/2017 | Beck | A41D 1/04 |

* cited by examiner

VEST ASSEMBLY

CROSS-REFERENCE TO RELATED APPLICATION

This application claims priority to U.S. Provisional Patent Application No. 62/216,690, filed Sep. 10, 2015, which is incorporated herein by reference.

BACKGROUND OF THE INVENTION

1. Field of the Invention

The subject disclosure relates to performance clothing, and more particularly to a vest that helps posture and core health when worn by a user by dynamically aligning, balancing and strengthening the core.

2. Background of the Related Art

Our evolving lifestyle has caused people of all age groups to develop forward leaning body positions through such activities as sitting for hours at a desk or at school, texting on our phones or tablets, playing video games and like sedentary activities. Anatomically, this forward position causes muscles and tendons to become overstretched with the potential to cause injury, pain and a decrease in quality of life.

Various attempts have tried to offer partial solutions to such problems. For example, U.S. PGPUB No. 2014/0303532 to Harding, published on Oct. 9, 2014, discloses a computer pain relieving vest. U.S. Pat. No. 7,681,249 to Oliver et al., issued on Mar. 23, 2010, discloses conditioning garments. U.S. Pat. No. 4,336,807 to Benckhuijsen, issued on Jun. 29, 1982, discloses a waistcoat for therapeutic treatment. Typically, the prior art approach of providing braces, which simply provide passive support, does little if anything to address the underlying problems.

SUMMARY OF THE INVENTION

In view of the above, a need exists for performance clothing to facilitate proper posture, joint orientation, and/or training. By being a core training device, the subject technology strengthens muscles and aligns joints. The subject technology can be a daily use product that prevents musculoskeletal injury or an existing injury from worsening. The subject technology, through routine use, can enhance core musculature from the neck to the low back, improve postural awareness, improve spinal and shoulder alignment, and assist with increasing circulation. The subject wearable exercise technology can be used with specific daily exercises to create muscle symmetry.

The subject technology allows users to be as active as possible while decreasing the risk of injury which in turn further enhances their lifestyles. The subject technology will provide daily musculoskeletal care. The subject technology can also facilitate muscle symmetry and allows for increased circulation through the deep breathing exercise. The improved posture is typically a decrease in forward head and forward shoulder position. As a result, the subject technology assists in proper posture, encourages proper body alignment and helps prevent neck pain, back pain, and shoulder pain. Additionally, the user will have increased self esteem through improved body positioning.

In one embodiment, the present disclosure is directed to a vest assembly including a bodice having at least one front pocket and at least one back pocket. A neck collar attaches to the bodice. Preferably, the neck collar includes compressive material to provide cushion and resistance. A collar adjustment, typically an elasticized material, providing adjustable resistance to the neck collar. A plurality of compressive inserts can be selectively inserted in the front pocket and/or the back pocket of the vest assembly. Each compressive insert is a compressive material to provide resistance to a frontal area of a chest of a user. The plurality of compressive inserts are interchangeable and come in varying weights and compressive and/or tensile strengths. By including the compressive inserts and an optional targeted exercise regimen, the subject technology provides an active wearable exercise technology to correct issues such as incorrect core muscle alignment.

The vest assembly may also include vest side adjustments of material that allows easy adjustment to breathing and posture alignment and/or a posture alignment compressive insert in the back pocket of the vest assembly. The posture alignment compressive insert is a compressive material such as to provide resistance behind shoulder blades of a user. The posture alignment compressive insert may also be a plurality of inserts in varying compressive strengths that are easily changed via a pocket. Preferably, the vest assembly is manufactured from materials that are light-weight and breathable for expansion and slight compression during resistance training. Typically, the neck collar extends approximately 1-3 inches above a neck line of a user. A zipper closure may close the front and the pockets are secured by a closure mechanism as well. Another vest assembly has an adjustable waist and/or side adjustments.

Still another embodiment of the present disclosure includes a vest assembly including a neck collar including compressive material to provide cushion and/or resistance, a collar adjustment of an elasticized material for providing adjustable resistance to the neck collar, and at least one compressive insert in a front of the vest assembly, the at least one compressive insert being a compressive material to provide resistance to a frontal area of a chest of a user. This vest assembly may include vest side adjustments of material that allows easy adjustment to breathing and posture alignment and/or a posture alignment compressive insert in a back and/or upper front of the vest assembly. The posture alignment compressive insert can be a compressive material such as to provide resistance behind shoulder blades of the user. Preferably, the posture alignment compressive insert is a plurality of inserts in varying compressive strengths that are easily changed via a pocket and the vest assembly is manufactured from materials that are light-weight and breathable for expansion and slight compression during resistance training and the neck collar extends approximately 1-3 inches above a neck line of a user. The vest assembly can also have a front zipper closure and the compressive inserts can come in varying compressive strengths that are easily changed via a pocket.

It should be appreciated that the subject technology can be implemented and utilized in numerous ways, including without limitation as a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the following drawings.

DETAILED DESCRIPTION OF PREFERRED EMBODIMENTS

Figure 1:
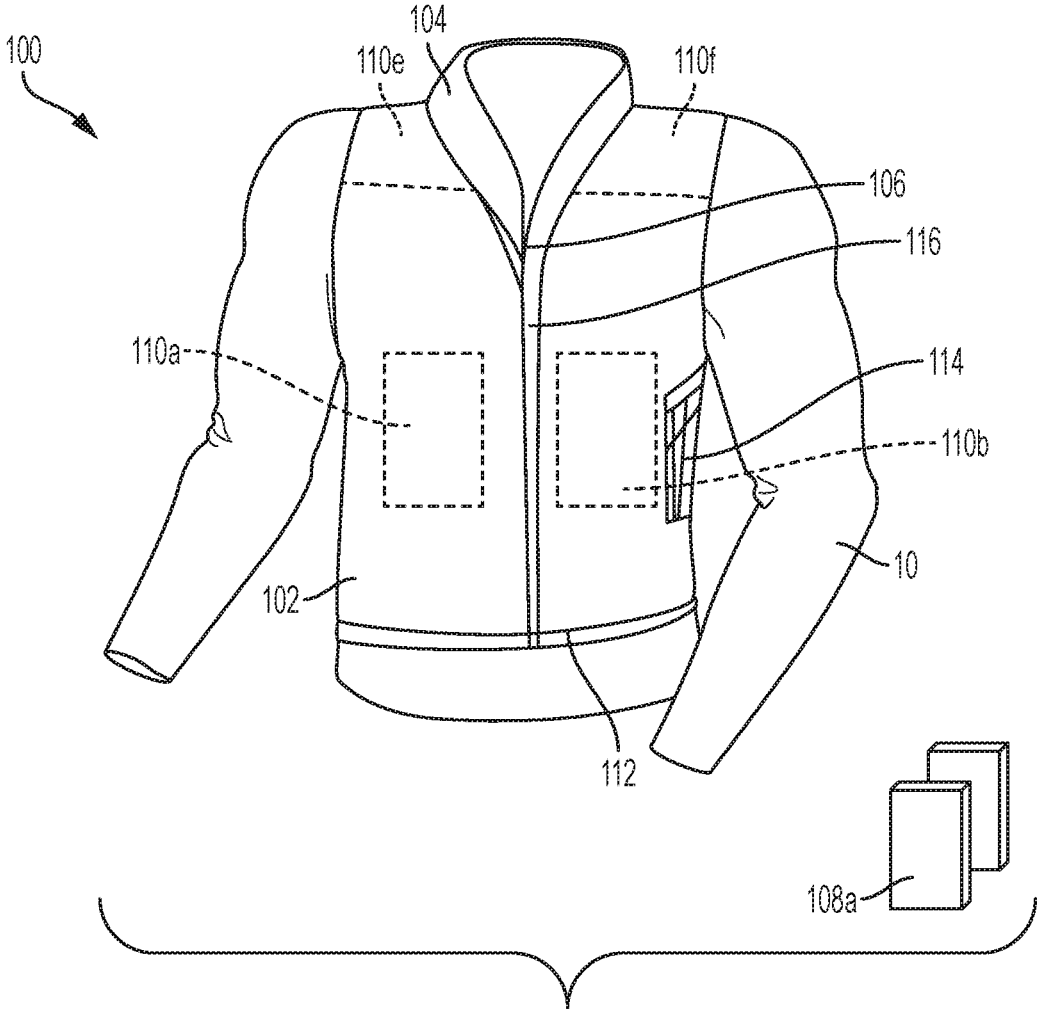
FIG. 1 is a front view of a vest assembly in accordance with the subject disclosure.

The subject technology overcomes many of the prior art problems associated with performance clothing. The advantages, and other features of the technology disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

Figure 2:
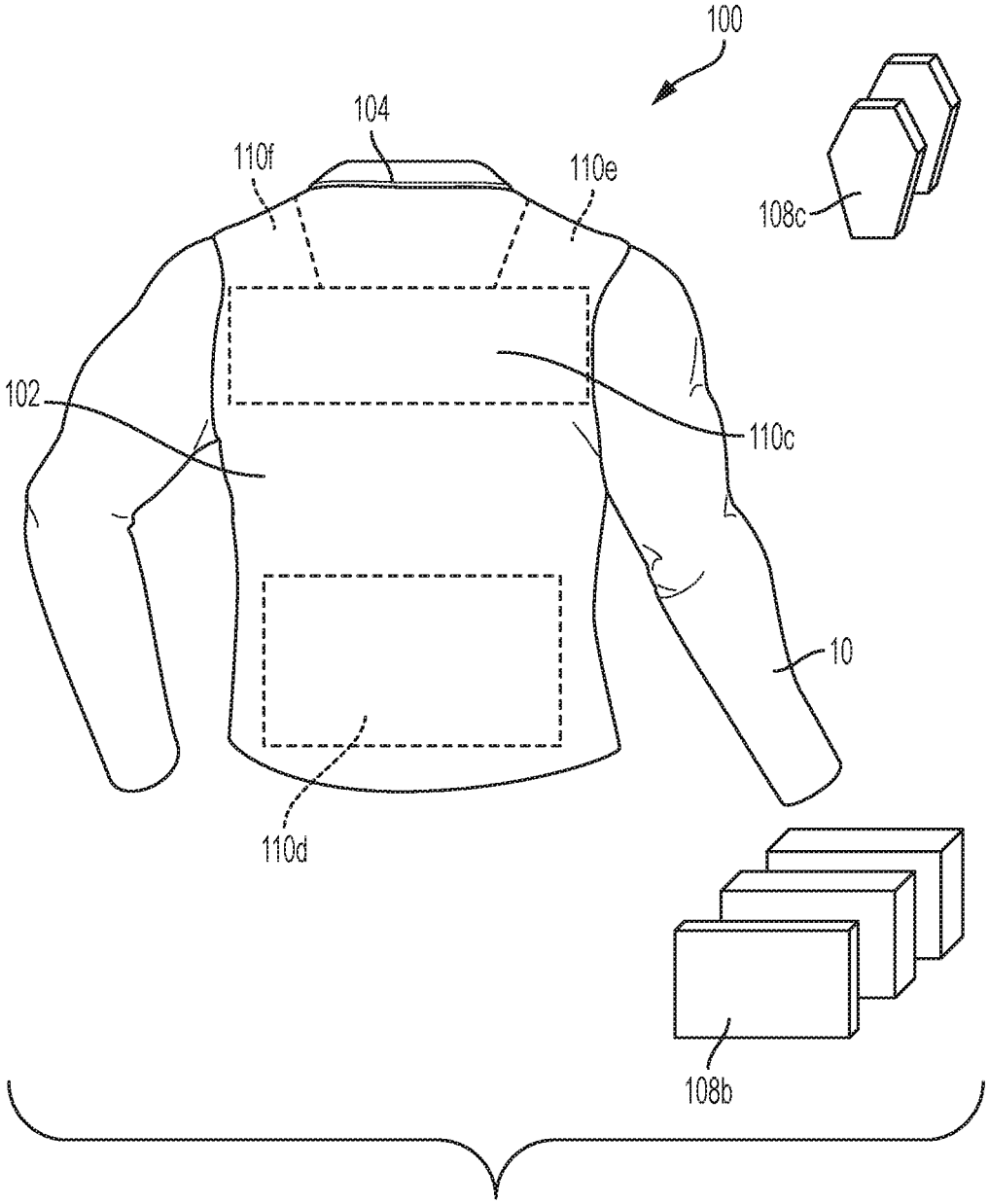
FIG. 2 is a back view of a vest assembly in accordance with the subject disclosure.

In brief overview, the subject technology is a vest with a plurality of features designed to help posture and improve core health. Referring now to FIGS. 1 and 2, front and back views of a vest assembly 100 are shown on a mannequin 10 for perspective. The vest assembly 100 is manufactured from materials that are light-weight/breathable in nature and allow flexibility for expansion and slight compression during resistance training. The vest assembly 100 is constructed using textile manufacturing processes and come in different colors with sizes ranging from XS to XXXL.

The vest assembly 100 has a bodice 102 with a neck collar 104 upstanding from the bodice 102. The bodice 102 may be fabricated of a compressive material. Preferably, the bodice material is also a wicking material to help keep the user dry and cool. The neck collar 104 is manufactured from the vest material and wrapped around specialized compressive types of material (not explicitly shown) to provide cushion/resistance when worn by a user. In one embodiment, the compressive material is a foam or soft rubber formed generally into a rod-shape that may be selectively removed and replaced to customize fit and performance. The neck collar 104 can extend approximately 1-3 inches above the neck line and be connected to the main vest as shown in FIG. 1.

The neck collar 104 can be adjusted for fit using a collar adjustment 106. Preferably, the collar adjustment 106 is extensions from each side manufactured from elasticized material as to provide adjustable resistance to the neck collar 104. The extensions may be coupled together by buttons/button holes, hook-and-loop fabric, a buckle/buckle holes and the like. The collar adjustment 106 is attached to the upper most front area 108*a* of the vest 100 as shown in FIG. 1. The collar adjustment 106 may include buttons, hook-and-loop fabric or other means for secure variable positioning closure.

The vest assembly 100 has compressive inserts 108*a* that are selectively inserted in pockets 110*a-d* of the bodice 102. Preferably, the inserts 108 are selected and inserted depending upon the activity or exercises (e.g., deep breathing resistance exercises, yoga, walking, weight training, circulation exercises etc.). The size and shape of the vest assembly as well as the location of the pockets 110*a-d* can vary depending upon the application and problems being addressed by the vest 100. For example, the bodice 102 would be differently shaped from women compared to men. The pocket may be secured by a closure mechanism or simply have an upper slot for removing and replacing compressive inserts.

The compressive inserts 108*a* are manufactured from specialized compressive types of material such as to provide resistance to the frontal area of the chest when inserted in pockets 110*a*, 110*b*. Typically, the inserts 108*a* are foam based products that can have varying durometers. The compressive inserts 108*a* can come in varying compressive strengths that are easily changed for an individual's condition and requirements. Typically, the inserts 108*a* are somewhat planar and formed into a shape to match the shape of the respective pocket 110*a-d*. It is envisioned that any shape may be used such as rectangles, squares, ovals, trapezoidal, hourglass and any irregular shape etc.

The vest assembly 100 has an adjustable waist 112. The adjustable waist 112 is manufactured from materials that allow easy adjustment and proper alignment of the vest 100 on the user. The adjustable waist 112 may include an arrangement similar to the collar. Alternatively, the adjustable waist 112 includes an elastic cord fed through a channel formed in the vest assembly with plastic toggle spring stop cord locks to fix the tightness. The vest assembly 100 also has vest side adjustments 114. The vest side adjustments 114 are also manufactured from materials that allow easy adjustment to breathing and posture alignment. Preferably, the side adjustment is manufactured from elasticized material as to provide adjustable resistance. The side adjustment may also simply be elastic material to provide snug fit, compression and/or resistance.

The vest assembly 100 also includes posture alignment compressive inserts 108*b* for the back pockets 110*c*, 110*d*. The posture alignment compressive inserts 108*b* are manufactured from specialized compressive types of material such as to provide resistance behind the shoulder blades as shown in FIG. 2. The posture alignment compressive inserts 108*b* can come in varying compressive strengths that are easily changed via a pocket built into the vest 100 for an individual's requirements.

For additional posture alignment and/or resistance, the vest assembly 100 includes shoulder pockets 110*e*, 110*f* for receiving compressive inserts 108*c* therein. The shoulder pockets 110*e*, 110*f* provide excellent resistance during certain shoulder movement to help tone the associated muscles. The compressive inserts 108*a-c* may come in varying thicknesses to vary the resistance and the like. Multiple inserts 108*a-c* may also be used in the same pocket to increase support and resistance. The vest assembly 100 has a front zipper 116 to make putting the vest assembly 100 on easy. It is also envisioned that the vest assembly 100 could include long sleeves with varying additional pockets for compressive inserts.

The vest assembly 100 is able to be worn during ones daily routine, with under or over other layers. The vest assembly 100 can provide support and alignment during activity to help prevent injury or worsening of existing conditions. The vest assembly 100 is also wearable during performing specific daily exercises to target certain areas and create muscle symmetry and strength. In any case, the vest assembly 100 also work the wearer's core more than regular clothing.

In one approach, the vest assembly 100 is used to address back and breathing line specific musculature, movement and exercise. For example, the head and neck (cervical spine) have the following musculature: splenius capitis, splenius cervicis, spinalis capitis, longissimus capitis, longissimus cervicis and longissimus thoracis. Effective movements, such as extension and head retraction, can be performed while wearing the vest assembly 100 in a standing or sitting upright position. More particularly, the user can draw their head back against the resistance collar 104 while keeping their head straight so that the neck is pushed back and held in position. By holding for 2-4 seconds and performing 3 sets of 12 repetitions, an effective workout can be accomplished. If necessary, the collar 104 can be tightened/loosened for increased/decreased resistance or the collar insert can be changed.

For upper mid-back and lower-back (cervical, scapulothoracic and lumbar spine), the vest assembly 100 facilitates proper alignment. For the trapezius, the vest assembly 100 accomplishes elevation adduction and rotation of the scapula. The vest assembly 100 also can shrug and push shoulder blades together. For the levator scapula, the vest assembly 100 elevates the scapula and shrugs the shoulders up. For the rhomboid major and minor, the vest assembly 100 elevates and retracts the scapula (e.g., shrug shoulders up and push shoulders blades together). For the posterior deltoid, the vest assembly pushes the shoulders back.

For musculature such as the iliocostalis, thoracis and lumborum extension of spine multifidus and rotators prone extension of spine, the wearer can do scapula elevation and scapula retraction in standing, sitting upright, or walking positions. In particular, a scapula elevation is a shrug of the shoulder against the resistance pad (e.g., elevate shoulders with arms down or elbow bent to 90 degrees) and hold 2-4 seconds for 3 sets of 12 repetitions. A scapula retraction is pinching the shoulder blades together with a hold for 2-4 seconds in 3 sets of 12 repetitions.

The movement of back extension involves the iliocostalis, thoracis and lumborum extension of spine multifidus and rotators prone extension of spine. Another exercise for back extension that can be performed while wearing the vest assembly 100 is to performed hip/lumbar extensions by lying prone with arms straight out in front and keeping the legs straight, tightening one leg, extending that leg at the hip, pressing against low back pad and holding for 2-4 seconds, for 3 sets of 12 repetitions, then repeating with the other leg.

Upper body extensions are also an excellent exercise to perform wearing the vest assembly 100. Upper body extension a done by lying prone with arms straight out in front and keeping the legs straight, while keeping the hips on the floor, the upper body is moved so that the chest and arms elevate from the floor, and the position is held for 2-4 seconds. For example, upper body extensions can be performed for 3 sets of 12.

Alternatively or in addition, side body extensions can be performed. Side body extension include lying prone with arms straight out in front and keeping the legs straight as well as the legs and arms are tightened. One alternates move one arm with the opposite leg also moving up. Resistance will be felt in the chest and lower back areas with the position held for 2-4 seconds. Then, the user switches to alternate sides and performs 3 sets of 12.

Full spine extensions are another exercise beneficially used with the vest assembly. Full spine extensions include lying prone with arms straight out in front and keeping the legs straight as well while tightening the legs and arms. Simultaneously, the upper body is moved so that the chest and arms elevate from the floor. Resistance will be felt in the chest and lower back areas while extending both legs at the hip, pressing against the low back pad and holding 2-4 seconds for 3 sets of 12.

The subject technology is particularly well-suited to breathing exercises. Breathing includes the inspiration and expiration musculature with movement such as rib elevation, rib depression, thoracic expansion and depression. Although possible to be done throughout the day in any position, users will benefit from wearing the subject technology and performing targeted exercises in standing or sitting upright positions. A simple exercise is to take a deep breath by inhaling through the nose and holding for 2 seconds, then slowly releasing the breath through the mouth. Like any exercise, various sets of various repetitions can be performed. Of course, the vest assembly 100 can be worn during "normal" breathing while walking, running, strength, yoga training and the like.

The subject technology can also be worn during strength training as well to ensure proper form and alignment (e.g., muscle balance). Exemplary strength-training exercises are the seated row, lat pull down, free weight training of back musculature and the like. A plurality of weighted inserts may be provided to make the vest assembly heavy by inserting the weighted inserts into the pockets. The weighted inserts may also be flexible and provide the same resistance function as non-weighted inserts.

Figure 3:
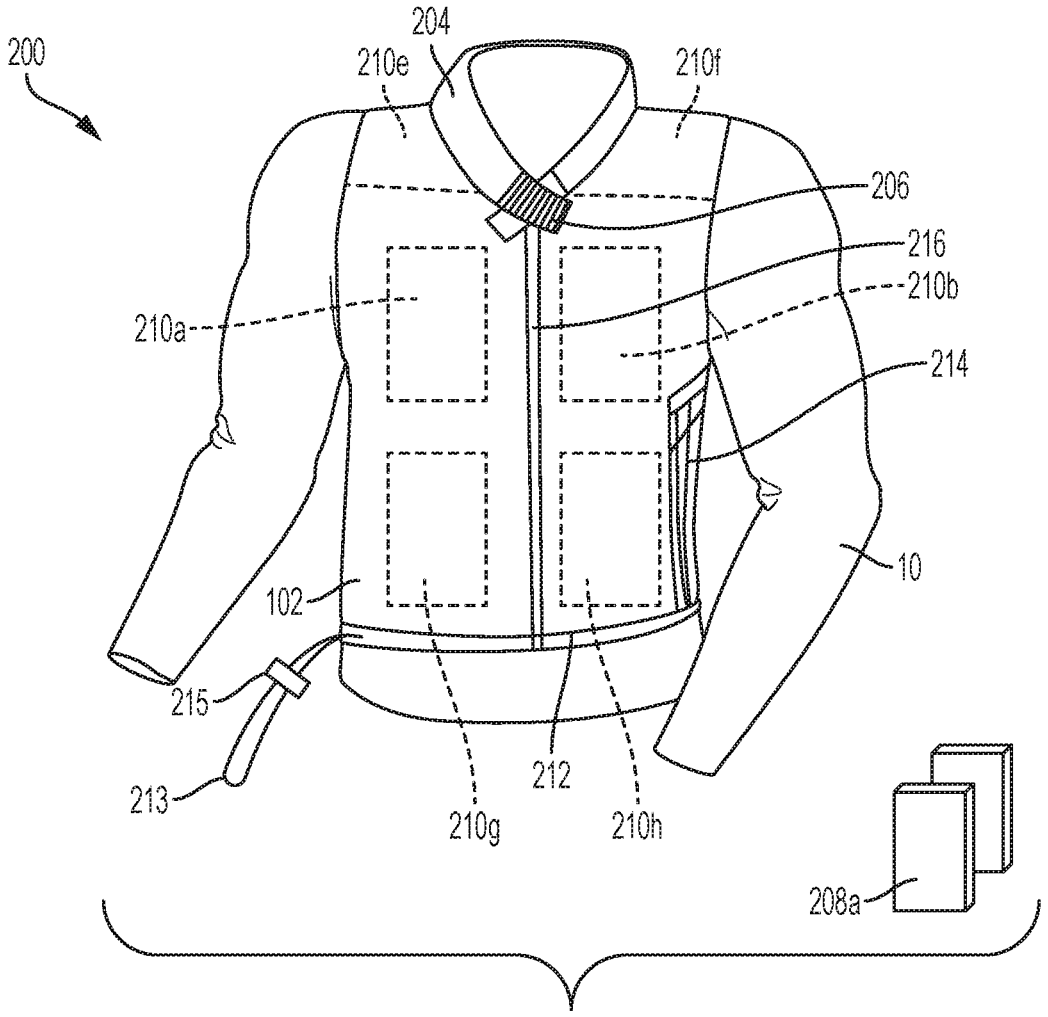
FIG. 3 is a front view of another vest assembly in accordance with the subject disclosure.
Figure 4:
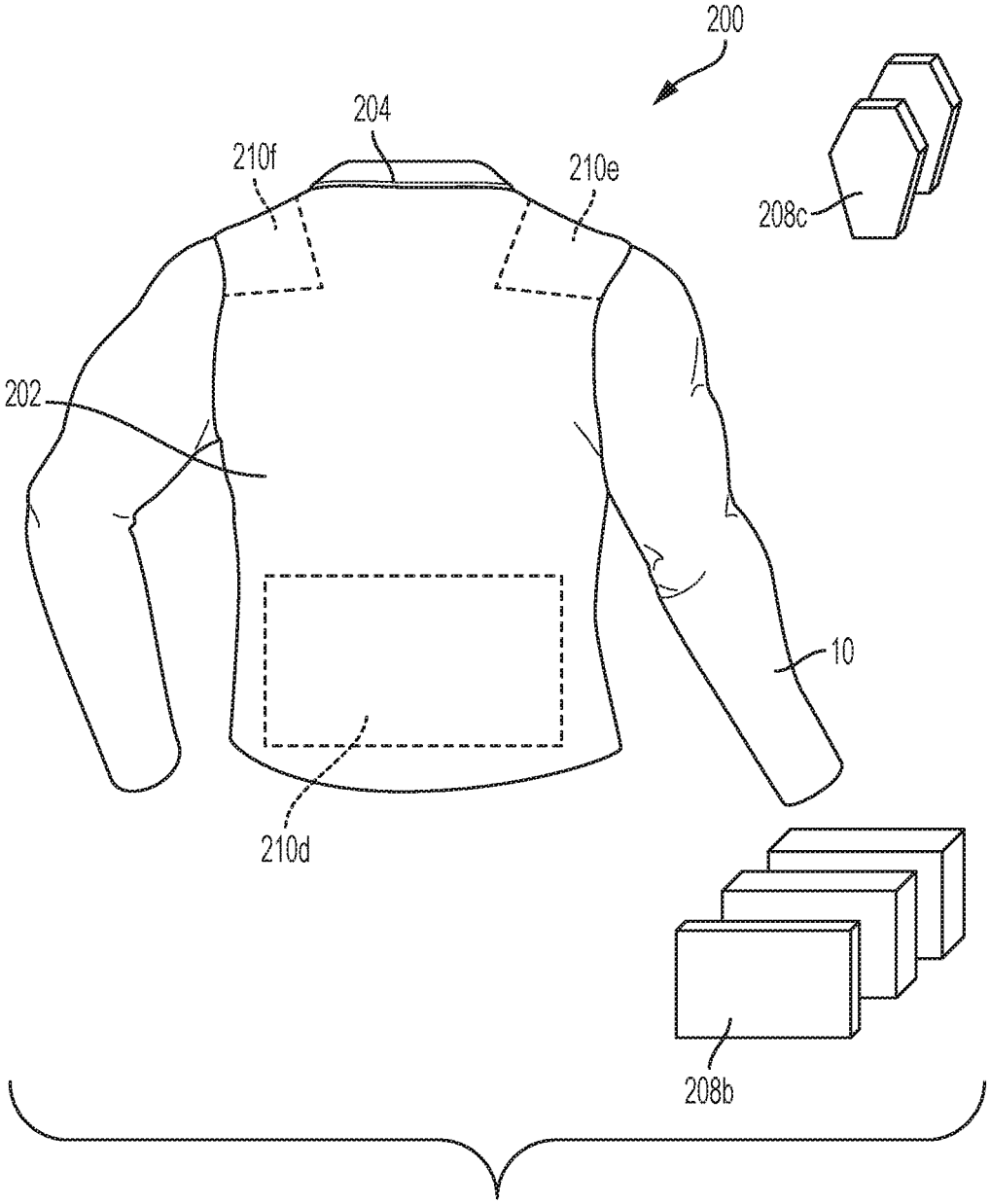
FIG. 4 is a back view of the vest assembly of FIG. 3.

Referring now to FIGS. 3 and 4, another vest assembly 200 in accordance with the subject disclosure is shown. Similar elements to those described in connection with above-described embodiments are indicated with the like "200" series reference numbers. Many elements are essentially the same as those of the foregoing embodiments and, thus, are not further described herein. A difference between the vest assembly 200 and the vest assembly 100 is the omission of the upper back pocket 110*c*. The vest assembly 200 includes several additional features including additional front pockets 210*g*, 210*h* and pockets 210*a*, 210*b* have been elevated to make room. The collar adjustment 206 includes opposing tabs of hook-and-loop fabric. The adjustable waist 212 includes an elastic shock cord 213 with a spring-loaded toggle cord lock 215.

As can be seen, the subject technology allows people to be as active as possible while dynamically aligning, balancing and strengthening the core and peripheral musculature. The subject technology assists with the prevention of injury caused by poor posture, muscle weakness and misaligned joints. The muscles of the neck, mid-back, lower-back and breathing are particularly well addressed by the subject technology.

It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements (e.g., collars, pockets, fabrics and the like) shown as distinct for purposes of illustration may be incorporated within other functional elements in a particular implementation. Further, although the subject technology has been described with respect to the field of performance clothing, it is envisioned that the subject technology would be equally applicable to other fields and applications such as straps, harnesses and other like training devices.

All patents, patent applications and other references disclosed herein are hereby expressly incorporated in their entireties by reference. While the subject technology has been described with respect to preferred embodiments, those skilled in the art will readily appreciate that various changes and/or modifications can be made to the subject technology without departing from the spirit or scope of the invention as defined by the appended claims. For example, each claim may depend from any or all claims in a multiple dependent manner even though such has not been originally claimed.

What is claimed is:

1. A vest assembly configured to improve posture and strengthen musculature of a user wearing the vest assembly, the vest assembly comprising:

a bodice comprising a front portion, a back portion, a first side portion, and a second side portion, the bodice having at least one front pocket located on the front portion and at least one upper back pocket and one lower back pocket located on the back portion;

a neck collar attached to the bodice and including compressive material to provide cushioning and resistance;

a collar adjustment of elasticized material for providing adjustable resistance to the neck collar;

at least one side adjustment located on at least one of the first side portion and second side portion, the at least one side adjustment made of elasticized material and configured to provide adjustable resistance and posture alignment when worn by the user;

and a first plurality of interchangeable compressive inserts, each insert in said first plurality of interchangeable compressive inserts comprising foam and at least one of the interchangeable compressive inserts of the first plurality differing from at least one other interchangeable compressive insert of the first plurality in weight and durometer value giving rise to different compressive strengths, at least one of the insert of the first plurality of interchangeable compressive inserts being selectively inserted in the at least one front pocket, and a second plurality of interchangeable compressive inserts, each insert in said second plurality of interchangeable compressive inserts comprising foam and at least one of the interchangeable compressive inserts of the second plurality differing from at least one other interchangeable compressive insert of the second plurality in weight and durometer value giving rise to different compressive strengths, at least one insert of the second plurality of interchangeable compressive inserts being selectively inserted in the at least one upper back pocket of the vest assembly, and a third plurality of interchangeable compressive inserts, each insert in said third plurality of interchangeable compressive inserts comprising foam and at least one of the interchangeable compressive inserts of the third plurality differing from at least one other interchangeable compressive insert of the third plurality in weight and durometer value giving rise to different compressive strengths, at least one insert of the third plurality of interchangeable compressive inserts being selectively inserted in the one lower back pocket of the vest assembly, each of the inserts of the first plurality of interchangeable compressive inserts, the second plurality of interchangeable compressive inserts, and the third plurality of interchangeable compressive inserts having a substantially planar shape matching a shape of the receiving at least one front pocket, at least one upper back pocket, and one lower back pocket respectively, and each of the compressive inserts of the first plurality of interchangeable compressive inserts, the second plurality of interchangeable compressive inserts, and the third plurality of interchangeable compressive inserts being selectively insertable and interchangeable in the receiving at least one front pocket, at least one upper back pocket, and one lower back pocket respectively to provide resistance in response to movements of the user wearing the vest assembly, thereby improving posture alignment and strengthening musculature of the user when worn.

2. The vest assembly as recited in claim 1, wherein at least one of the inserts in each of the first and second plurality of interchangeable compressive inserts has a thickness different from that of at least one of the other inserts in each of the first and second plurality of interchangeable compressive inserts to provide selectively varying resistance in response to movements of the user wearing the vest assembly.

3. The vest assembly as recited in claim 1, wherein the at least one insert of the second plurality of interchangeable compressive inserts is located on an upper part of the back portion corresponding to a user's shoulder blades, the back pocket having the at least one insert of the second plurality of interchangeable compressive inserts providing resistance behind shoulder blades of the user.

4. The vest assembly as recited in claim 1, wherein the at least one front pocket includes at least one insert of the first plurality of interchangeable compressive inserts located on an upper part of the front portion corresponding to a user's chest, the front pocket having the at least one insert of the first plurality of interchangeable compressive inserts providing resistance to the frontal area of the user's chest through compression of the material when worn, strengthening a user's musculature.

5. The vest assembly as recited in claim 1, wherein the vest assembly is made from materials that enable expansion and compression during resistance training by the user.

6. The vest assembly as recited in claim 1, wherein the neck collar is configured to extend approximately one to three inches above a neck line of the user.

7. The vest assembly as recited in claim 1, further comprising at least one weighted element for selective insertion in at least one of the at least one front pocket, the at least one upper back pocket, and the one lower back pocket.

8. The vest assembly as recited in claim 1, wherein the at least one front pocket and the at least one back pocket are each secured by a closure mechanism in the at least one front pocket and at least one back pocket.

9. The vest assembly as recited in claim 1, further comprising an adjustable waist.

10. A method for enhancing a lifestyle of a user comprising the steps of: providing a vest assembly for daily wear to promote musculoskeletal care, proper posture and proper body alignment, wherein the vest assembly comprises a bodice comprising a front portion, a back portion, a first side portion, and a second side portion, the bodice having at least one front pocket located on the front portion and at least one upper back pocket and one lower back pocket located on the back portion; a neck collar attached to the bodice and including compressive material to provide cushioning and resistance; a collar adjustment of elasticized material for providing adjustable resistance to the neck collar; at least one side adjustment located on at least one of the first side portion and second side portion, the at least one side adjustment made of elasticized material and configured to provide adjustable resistance and posture alignment when worn by the user; and a first plurality of interchangeable compressive inserts, each insert in said first plurality of interchangeable compressive inserts comprising foam and at least one of the interchangeable compressive inserts of the first plurality differing from at least one other interchangeable compressive insert of the first plurality in weight and durometer value giving rise to different compressive strengths, at least one of the insert of the first plurality of interchangeable compressive inserts being selectively inserted in the at least one front pocket, and a second plurality of interchangeable compressive inserts, each insert in said second plurality of interchangeable compressive inserts comprising foam and at least one of the interchangeable compressive inserts of the second plurality differing from at least one other interchangeable compressive insert of the second plurality in weight and durometer value giving rise to different compressive strengths, at least one insert of the second plurality of interchangeable compressive inserts being selectively inserted in and the at least one upper back pocket of the vest assembly, and a third plurality of interchangeable compressive inserts, each insert in said third plurality of interchangeable compressive inserts comprising foam and at least one of the interchangeable compressive inserts of the third plurality differing from at least one other interchangeable compressive insert of the third plurality in weight and durometer value giving rise to different compressive strengths, at least one insert of the third plurality of interchangeable compressive inserts being selectively inserted in the one lower back pocket of the vest assembly, each of the inserts of the first plurality of interchangeable compressive inserts, the second plurality of interchangeable compressive inserts, and the third plurality of interchangeable compressive inserts having a substantially planar shape matching a shape of the receiving at least one front pocket, at least one upper back pocket, and one lower back pocket respectively, and each of the compressive inserts of the first plurality of interchangeable compressive inserts, the second plurality of interchangeable compressive inserts, and the third plurality of interchangeable compressive inserts being selectively insertable and interchangeable in the receiving at least one front pocket, at least one upper back pocket, and one lower back pocket respectively to provide resistance in response to movements of the user wearing the vest assembly, thereby improving posture alignment and strengthening musculature of the user when worn; wearing the vest assembly daily for a predetermined period of time to facilitate muscle symmetry and increased circulation; and performing at least one set of breathing exercises by repeatedly holding a full breath inhaled nostrally and slowly exhaling orally while wearing the vest assembly.

* * * * *